US006318064B2

(12) United States Patent
Vandini

(10) Patent No.: US 6,318,064 B2
(45) Date of Patent: Nov. 20, 2001

(54) BRACELET WITH LIGHTENED LINKS

(75) Inventor: Alexandre Vandini, Commugny (CH)

(73) Assignee: Patek Philippe S.A., Plan-Les-Oates (CH)

( * ) Notice: Subject to any disclaimer, the term of this patent is extended or adjusted under 35 U.S.C. 154(b) by 0 days.

(21) Appl. No.: 09/750,109

(22) Filed: Dec. 29, 2000

(30) Foreign Application Priority Data

Mar. 17, 2000 (EP) ..... 00105696

(51) Int. Cl.[7] ..... F16G 15/04
(52) U.S. Cl. ..... 59/80; 59/100; 63/4
(58) Field of Search ..... 59/801, 900; 63/4

(56) References Cited

U.S. PATENT DOCUMENTS 4,089,161 * 5/1978 Aoki ..... 59/80
6,026,637 * 2/2000 Dombre et al. ..... 59/80

FOREIGN PATENT DOCUMENTS

| | | |
|---|---|---|
| 2278285 | 2/1976 | (FR) . |
| 2738122 | 3/1997 | (FR) . |
| 1329388 | 9/1973 | (GB) . |
| 2240460A | 8/1991 | (GB) . |

* cited by examiner

*Primary Examiner*—David Jones
(74) *Attorney, Agent, or Firm*—Young & Thompson

(57) ABSTRACT

A lightened bracelet with articulated metallic links includes lateral links (4*a*, 4*b*) connected by two pins (3) or screws (6) and at least one row of central links articulated on two pins (3) or screws connecting different lateral links. The central links comprise a tubular metallic envelope (1) in which is disposed at least one insert (2) of plastic material provided with two passages each receiving with low friction a pin (3) or a screw (6).

7 Claims, 1 Drawing Sheet

BRACELET WITH LIGHTENED LINKS

FIELD OF THE INVENTION

The present invention has for its object a bracelet which can be a watch bracelet, of precious metal, generally gold, silver or platinum.

To avoid the weight and price of the bracelet being too high, the bracelet according to the present invention comprises lightened links.

BACKGROUND OF THE INVENTION

There are known lightened links for articulated bracelets in precious metals, from FR-2 738 122. These links comprise, in addition to the openings giving passage to the pins connecting the links to each other, lightening recesses. A bracelet made of such links has numerous drawbacks which are for example the fact that, seen laterally, the central lightening recess is visible, the lightening recesses can easily fill with water, dust or other dirt. Moreover, the friction of the securement pins in the passages of the links provided for this effect, is a metal-on-metal friction, which gives rise to wear of the links and blackening of them.

SUMMARY OF THE INVENTION

The present invention has for its object a bracelet comprising lightened links avoiding the mentioned drawbacks.

The object of the present invention is the provision of a bracelet comprising metallic links articulated to each other, whose weight will be reduced, as well as the price, particularly when the bracelet is of precious metal. Another object of the present invention is to provide a bracelet with articulated metallic links, avoiding any metal-on-metal friction, to avoid wear and soiling the links.

Still another object of the present invention is the provision of a bracelet comprising lightened metallic links whose cavities cannot fill with water, dust or other dirt. Another object of the invention is again to overcome the corrosion of the metallic links of the bracelet generally due to the potential difference between the links and their articulation pins which are of a different metal. Still another object of the present invention is to provide a low friction pivoting of the links on the articulation pins. Finally, another object of the present invention is that the bracelet according to the invention can, despite the fact of lightened links, meet the Swiss and European standards concerning marking of objects in precious metals.

The bracelet according to the present invention permits achieving all these objects, moreover it is easy to produce and to assemble. This bracelet is distinguished by the characteristics set forth in claim 1.

BRIEF DESCRIPTION OF THE DRAWINGS

The accompanying drawing shows schematically and by way of example an embodiment of the bracelet according to the invention.

DETAILED DESCRIPTION OF THE INVENTION

Figure 1:
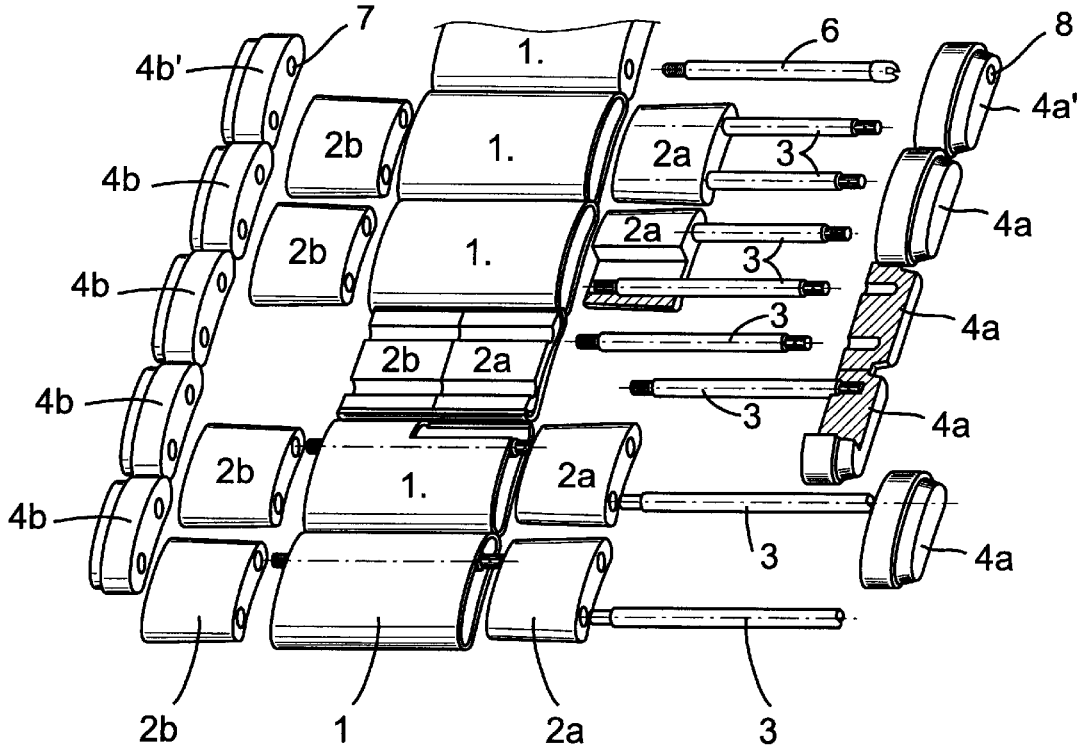
FIG. 1 is an exploded perspective view of a portion of the bracelet.
Figure 3:
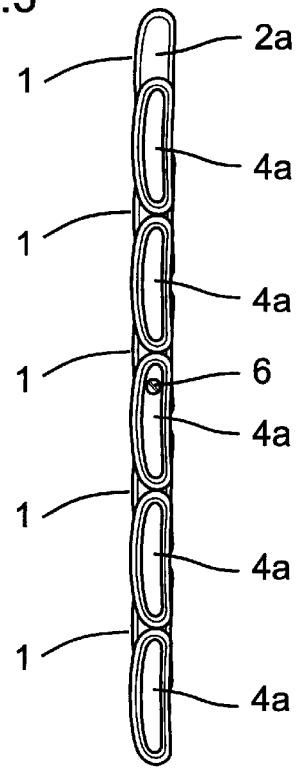
FIG. 3 is a side view of a portion of the bracelet.
Figure 2:
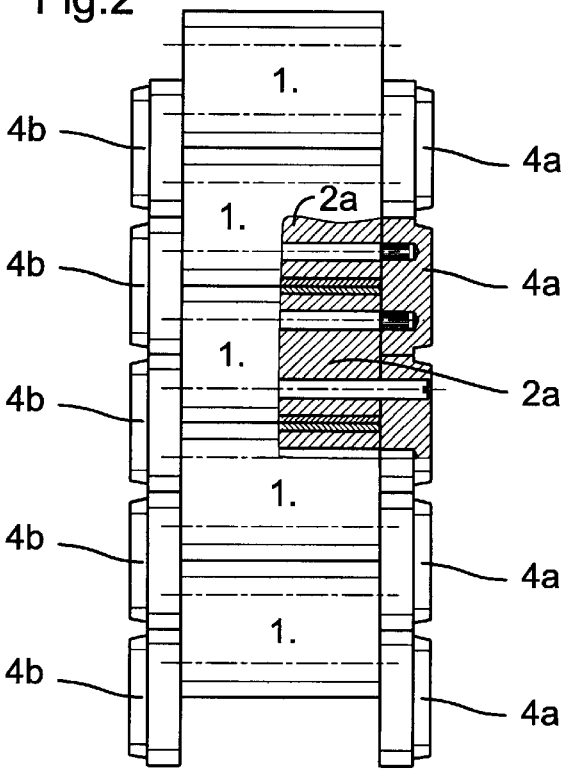
FIG. 2 is a top plan view, partially in cross-section, of a portion of the bracelet.

In its illustrated embodiment, the bracelet with articulated and lightened metallic links comprises a central row of links comprising a tubular envelope 1 of metal, preferably precious metal. These tubular envelopes can be of gold, platinum or silver, but also in any other metal, generally a precious metal or of a high price. Thanks to the fact that the central links 1 are tubular, their weight is reduced as well as their price. Moreover, the production of these tubular envelopes of the central links 1 is easy, they are for example obtained by extrusion and then cut to the desired length and polished.

The central links 1 also comprise two inserts 2*a*, 2*b* of plastic material, for example polyurethane, which in service position are introduced from opposite sides of a tubular envelope 1 and entirely fill the empty space of this envelope 1. These inserts 2*a*, 2*b* are force-fitted into an envelope 1 and prevent any penetration of water of dust into the central links 1. These inserts 2*a*, 2*b* comprise two passages for the articulation pins 3 of which the central portion slides with low friction in these passages. The ends of these articulation pins 3 comprise longitudinal striations and are force-fitted into blind holes in the side links 4*a*, 4*b*. Two pins 3 of a central link are each force-fitted into two lateral links 4*a* and two lateral links 4*b*, thereby forming the chain of the bracelet.

To permit lengthening the bracelet, certain pins are replaced by screws whose central portion slides with low friction in the passages of two inserts 2*a*, 2*b* and whose end is screwed into a tapping 7 in the side link 4*b*' and whose head, of greater diameter, is received in the portion of greater diameter of a through-hole 8 which is in the side link 4*a*'.

The present of inserts 2*a*, 2*b* force-fitted into the envelope 1 of the central links, gives to the latter increased rigidity and good resistance to shocks. These same inserts 2*a*, 2*b* prevent any contact and friction between the pins 3 and the screws 6, with the envelopes 1 of the central links, also avoiding any corrosion, any potential difference or abrasion.

In modifications of the described bracelet, it is evident that the inserts 2*a*, 2*b* could be made in a single piece. The pins 3 could be cemented, force-fitted, screwed or welded according to suitable techniques, to the side links 4*a*, 4*b*.

So that such a bracelet satisfies the standards in force for marking objects of precious metal in Switzerland and in Europe, it suffices that the thickness of the envelopes 1 of the central links be at least 0.5 mm and that the color or appearance of the visible portions of the inserts 2*a*, 2*b* when they are in service position forced into an envelope 1, is clearly differentiated from the color and appearance of this envelope.

The mobility of the links relative to each other is very good and smooth, because the pins and the screws pivot in a plastic material, which avoids any gripping, play, corrosion or abrasion.

The bracelet is lighter than if the central links were solid and of course less expensive, the precious metal removed being replaced by plastic material.

The solidity of the bracelet and particularly the central links is excellent, because of the presence of inserts which avoids any deformation of the tubular envelopes of the central links.

In other modifications of the bracelet, it is evident that it could comprise several parallel rows of central links 1, 2*a*, 2*b* and not alone a single one as illustrated.

What is claimed is:

1. A lightened bracelet with articulated metallic links, comprising lateral links connected by two pins or screws and at least one row of central links articulated on two of said pins or screws connecting the different lateral links; each of said central links comprising a tubular metallic envelope in which is wedged or force fitted at least one insert of plastic material provided with two passages each receiving with low friction one of said pins or screws.

2. The bracelet according to claim 1, wherein the lateral links and the envelopes of the central links are of precious metal.

3. The bracelet according to claim 1, wherein the pins are connected to the lateral links by one of force-fitting, cementing, screwing, and welding.

4. The bracelet according to claim 1, wherein each envelope of the central link has a thickness of at least 0.5 mm.

5. The bracelet according to claim 4, wherein the appearance of visible portions of the inserts is different from the appearance of the envelope of the central links.

6. The bracelet according to claim 4, wherein the color of visible portions of the inserts is different from the color of the envelope of the central links.

7. The bracelet according to claim 1, wherein two inserts are disposed in each envelope.

* * * * *